United States Patent [19]

Tanaka

[11] 4,278,199

[45] Jul. 14, 1981

[54] POST CARD

[76] Inventor: Yoshio Tanaka, 2-7-6, Shibuya, Shibuya-ku, Tokyo, 150, Japan

[21] Appl. No.: 56,038

[22] Filed: Jul. 9, 1979

[51] Int. Cl.[3] ..... B65D 27/32; B42D 15/02

[52] U.S. Cl. ..... 229/92.8; 229/70; 283/6

[58] Field of Search ..... 229/69, 70, 92.8, 610, 229/1 B; 283/6, 56, 57, 58, 113; 282/28

[56] References Cited

U.S. PATENT DOCUMENTS

| | | | |
|---|---|---|---|
| 89,507 | 4/1869 | Saladee | 229/70 |
| 709,805 | 9/1902 | Stearns | 229/70 |
| 2,666,655 | 1/1954 | Wolowitz | 282/25 |
| 3,126,211 | 3/1964 | Hieken | 283/6 |
| 3,261,623 | 7/1966 | Kiedrowski | 282/25 |
| 3,329,333 | 7/1967 | Ormond | 229/92.8 |
| 3,713,238 | 1/1973 | Hyman | 229/92.8 |
| 3,899,127 | 8/1975 | Melander | 229/92.8 |
| 4,172,605 | 10/1979 | Welsch | 229/69 |

*Primary Examiner*—Herbert F. Ross

*Attorney, Agent, or Firm*—Victor R. Beckman

[57] ABSTRACT

A post card is disclosed which includes a rectangular-shaped base member conforming in shape and size to requirements of the United Postal Service, and an opaque cover member of substantially smaller size than the base member attached to the base member. At least a portion of the information to be transmitted by use of the post card is carried in full view at one face of the base member. Another portion of the information is carried on one of the facing surfaces of the base and cover members for normally hiding such portion from view. At least a portion of the cover member, or a portion of the base member underlying the cover member, is removable by the recipient of the post card to expose to view such normally-hidden message portion. The portion of the message to be hidden may be imprinted before the cover member is attached to the base member. Alternatively, means may be included for transferring impressions entered on the cover member, or base member opposite the cover member, onto the underlying cover or base member to allow for the entering of the hidden portion of the message after the cover member is affixed to the base member.

10 Claims, 12 Drawing Figures

POST CARD

BACKGROUND OF THE INVENTION

Post cards and letters for delivery by the Postal Service commonly are used in the transmission of messages, data, information, and the like. When it is desired to maintain the confidentiality of the information, an envelope often is employed to hide the message from view by everyone except the recipient. The information, or message may be contained on a separate sheet inserted in the envelope, or applied directly to an interior surface of the envelope. Envelope blanks are available upon which the message first may be applied, after which the blank is folded to form an envelope with the message at an inside surface thereof hidden from view. As is understood, envelopes to be mailed must bear letter rate postage which is, of course, greater than post card rate postage. Double post cards are available which include mailing and return post card sections connected along a fold line. However, the sections generally are not sealed, or closed, about the entire periphery of the card sections, thereby allowing inspection of any message contained at the inside facing surfaces thereof. In brief, prior art post cards provide a price advantage over letters in the cost of mailing, and often in the cost of production, but lack the privacy afforded by the use of an envelope to contain the message.

SUMMARY OF THE INVENTION AND OBJECTS

An object of this invention is the provision of an improved post card which can be sent at post card rates, as opposed to letter rates, and which includes means for concealing at least a portion of a message or information contained thereon to insure the privacy of such concealed information.

The above and other objects and advantages are achieved by use of a rectangular-shaped base member of post card size and made of paperboard, or like material. An opaque cover member, of paper, paperboard, or the like, but of smaller size than the base member, is attached about its entire margin to the base member in facing engagement therewith to conceal a portion of the message, or information, contained at one of the facing surfaces. The recipient of the postcard simply removes either the cover member or a portion of the base member at the cover member, for viewing the normally-concealed portion of the message. In one form of the invention, the message to be transmitted may be applied to the base member, and the opaque cover member then is applied to the base member at the portion of the message to be hidden from view. In another form of the invention means for transferring impressions are included between said base and cover members. The cover and image transfer means are attached to the base member before the hidden message portion is supplied to the card. With this arrangement, information to be hidden from view is impressed on the cover member, or base member at the cover member, for transfer to the base or cover member, depending upon the orientation of the image transfer means located therebetween. If desired, image transfer means which provide colored hidden indicia may be used.

The invention, as well as other objects and advantages thereof, will become apparent from the following detailed description when considered with the drawings.

BRIEF DESCRIPTION OF THE DRAWINGS

In the drawings, wherein like reference characters refer to the same parts in the several views.

There are numerous situations when only a portion of the total data, information, or message to be sent by mail is required to be hidden from view by all but the recipient of the correspondence. For example, banks, savings and loan associations, credit unions and others holding accounts of customers are obligated to periodically report the deposit balance in the customer's account. Similarly, security brokers periodically report on the balance of customer's securities held by the broker. University, colleges, and like teaching institutions often report student grades by mail. In all such cases a letter generally is used to make such notifications through the mail. It will be apparent, however, that only a portion of the information, or message, to be sent is required to be hidden from view in order to adequately protect the recipient's right of privacy. In accordance with the present invention a post card is provided which includes a post card-sized base member having an opaque cover member of less than postcard size attached thereto to hide from view information included therebetween. The cover member, or portion of the base member at the cover member, is removed by the recipient of the card for viewing of the normally concealed information. Such a post card may be sent at the lower post card rate while, at the same time, hiding from normal view information which it is desired to be kept private.

Figure 1:
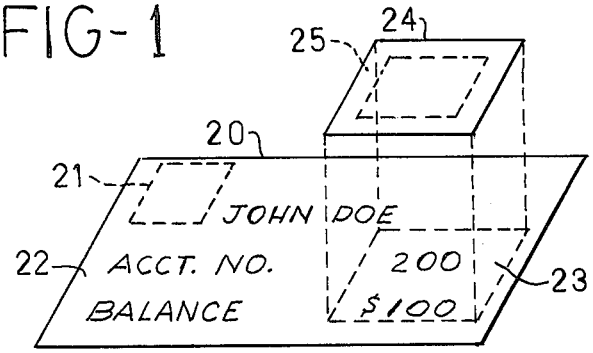
FIG. 1 is an exploded perspective view of a post card embodying this invention.
Figure 2:
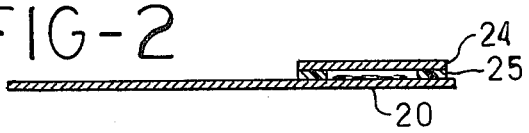
FIG. 2 is a cross sectional view of the post card shown in FIG. 1 taken across the cover member.

In a simple form of the invention illustrated in FIGS. 1 and 2, to which reference now is made, the novel post card is shown comprising a base member 20 formed of a sheet of paperboard, or the like, of post card size and shape; i.e. of a size and shape acceptable for mailing via the postal service. For purposes of description, the side shown in FIG. 1 is designated the back side of the post card. The front side includes a mailing area for the name and address of the recipient of the post card and a postage area 21 at the upper right corner thereof, shown in broken lines in FIG. 1. A return address and a message area also may be included at the front side of the base member, if desired.

The back side of the base member shown in FIGS. 1 and 2 includes normally visible and normally invisible, or hidden, message areas 22 and 23, respectively. The hidden message area 23 is adapted to be covered by an opaque cover member 24 made of paper, paperboard, or the like, and having a size smaller than that of the base member 20. The cover member 24 is releasably secured to the base member 20 by any suitable means such as by use of adhesive 25 which may be coated on the entire inner surface of the cover member, or along the marginal edges thereof, as illustrated.

Before releasably securing the cover member 24 to the base member 20, data, information, or a message to be transmitted is applied to the rear of the base member, either by hand or by machine. For purposes of illustration only, and not by way of limitation, the message is shown to include an account holder's name, "JOHN DOE" an account number "ACCT. NO.200", and the remaining balance, "BALANCE $100". Of the information included, information to be hidden from view is located within the area 23 to be covered by the cover member 24. In the illustrated message, the account number "200" and balance "$100" are located in this area.

After the desired message is applied to the base member 20, the area 23 to be hidden from view is covered by cover member 24. Upon receipt of the post card, the recipient need only remove the cover member 24 to view the entire message, including the normally hidden portion thereof within area 23 of the base member. Where large numbers of such messages are required to be sent periodically, it will be apparent that substantial savings result by use of the novel post card as compared, for example, to the use of envelopes requiring the use of letter rate postage.

The remainder of the embodiments shown in the drawings, and described below, include the use of impression transfer means such as carbon paper, duplicating pressure-sensitive or duplicating carbonless paper, carbon spots, color transfer means, or the like, for the transfer of impressions made on the cover, or on the base member directly opposite the cover, onto one of the facing surfaces between the cover and base members. With such arrangements, the cover member may be applied to the base member before the hidden message portion is supplied to the post card.

Figure 3:
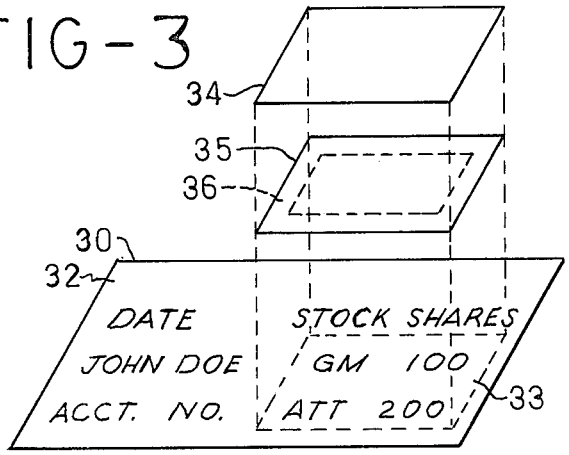
FIG. 3 is a view which is similar to that of FIG. 1 but showing a modified form of this invention which includes impression transfer means.
Figure 4:
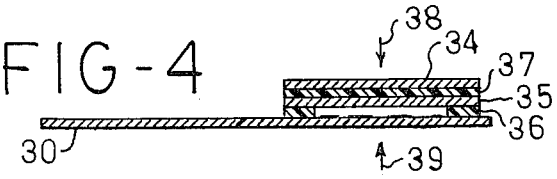
FIG. 4 is a cross sectional view of the post card shown in FIG. 3 taken across the cover member.

Referring now to FIGS. 3 and 4, a post card is shown comprising a base member 30 having a normally visible area 32 and a normally hidden area 33 covered by a cover member 34 in the form of an opaque slip, or sheet, of material. The base and cover members may be formed of the same materials as the corresponding base and cover members shown in FIGS. 1 and 2 and described above. In the present embodiment, a sheet of carbon paper 35 is located between the cover and base members. It is releasably secured to the base member 30 as by adhesive 36 which may be coated on one entire surface of the carbon paper, or along the marginal edges thereof, as illustrated. The carbon paper 35 is attached to the cover member 34 as by the use of adhesive 37, or the like.

With this, and other embodiments described below, the card elements may be assembled before entering the message to be transmitted on the card. The normally visible area 32 of the assembled post card is provided with the visible portion of the message by any suitable method such as printing, writing, or the like. The portion of the message to be concealed, or hidden, from view is supplied to the normally hidden message area by the transfer of impressions made at the cover member onto the base member through the carbon paper 35. Obviously, printing of a legible message at the outer face of the cover member when transferring the impression to the normally hidden area 33 of the base member is to be avoided. Type, without ink, may be used to impress the message onto the cover member 34. For handwritten messages, a steel pen may be used. Alternatively, a transparent plastic sheet may be temporarily located over the cover member 34, through which sheet the desired indicia may be transferred onto the post card using, for example, a ball-point pen. In any case, the hidden message portion is transferred onto the base member through use of the carbon paper without visible entry of the message on the outside of the post card. The cover 34 and attached carbon paper 35 are removed by the recipient to allow for reading of the entire message, including that portion within normally concealed area 33 of the base member.

For purposes of illustration only and not by way of limitation, the post card of FIGS. 3 and 4 is shown used for transmitting information concerning a customer's securities. The rear of the card is shown printed with the date, stock, number of shares and customer's name and account number. The actual name of the stock (here GM and ATT) and number of shares held by the broker (here 100 and 200) are shown contained within the normally concealed area 33. As noted above, this information is printed on the base member by impression transfer through the carbon paper 35 without printing or visible display of the information outside of the normally concealed area. Normally the cover 34 would be impressed with the desired indicia, in the direction of the arrow 38, for transfer onto the base member. Obviously, the desired information may be impressed from the front of the post card, in the direction of arrow 39, if desired. In this case, if type is used, type which is a mirror image of normal type would be employed for transfer of proper-appearing impressions onto the back of the base member.

Figure 5:
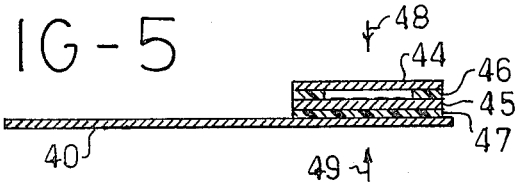
FIG. 5 is a view which is similar to that of FIG. 4 but showing a cross section of another modified form of this invention wherein the impression transfer means is positioned for transfer of the impression onto the inner face of the cover member rather than onto the base member.

In another modified form of this invention the carbon paper 35 is positioned for transfer of images onto the inner face of the cover member, rather than onto the base member, as in the FIGS. 3 and 4 arrangement. Such a modified form of the invention is shown in FIG. 5, to which figure reference now is made. The illustrated post card comprises a base member 40, a slip of carbon paper 45 secured by adhesive 47 to the base member at the area to be concealed from view, and a cover member 44 attached to the carbon paper 45 by adhesive 46 extending along the peripheral edges thereof. As noted above, the postcard elements are the same as those employed in the arrangement shown in FIGS. 3 and 4, except that the carbon paper is positioned for transfer of information onto the cover member 44 rather than onto the base member. Normally, information to be hidden from view would be transferred to the cover member 44 through the carbon paper slip 45 by impressions made at the front of the post card, in the direction of arrow 49. Alternatively, the information may be impressed onto the cover member 44, in the direction of arrow 48, for transfer onto the inner face of the cover member through means of the carbon paper 45.

Figure 6:
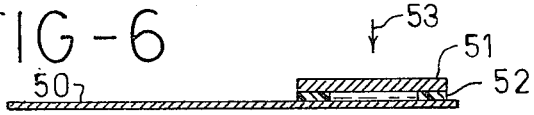
FIG. 6 is a cross sectional view similar to that of FIG. 5 but showing another modified form of this invention employing carbonless paper as a combination cover member and impression transfer means.

The invention, of course, is not limited to use of carbon paper as the impression transfer means. Other well-known impression transfer means, including so-called "carbon-less" paper, and carbon spots, may be used in the practice of the present invention. In FIG. 6, to which reference now is made, a post card is shown comprising a base member 50 of post card size and shape, and a slip of duplicating pressure sensitive, or carbon-less, paper 51 releasably attached thereto. For purposes of illustration, heat-sealable material 52 extending about the marginal edges of the carbon-less paper is shown for securing the carbon-less paper slip to the base member when heated to the required temperature. Indicia to be hidden are provided by impressing the carbon-less paper member 51 with the desired information, in the direction of arrow 53, for transfer of the information onto the base member 50 through the carbon-less paper. Here, the carbon-less paper functions both as means for transferring the impression onto the base member, and to hide the image created at the base member from view. The carbon-less paper is removed from the base member by the recipient of the post card to expose the normally hidden indicia to view.

Figure 7:
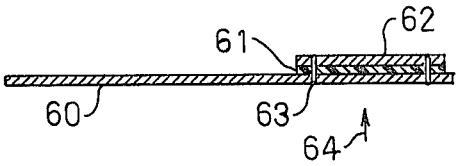
FIG. 7 is a cross sectional view of a post card showing another modified form of this invention employing a carbon spot on the base member as impression transfer means, and perforations for securing the cover member to the base member.

In the FIG. 7 arrangement, to which reference now is made, a carbon spot 61 is provided on the post card-size and shape base member 60 at the area to be hidden from view. A cover member 62 is attached to the base member at the carbon spot by any suitable means, such as perforations 63 punched through the cover and base members along the marginal edges of the cover member. Normally, the post card would be impressed with the information to be hidden from view at the front of the base member, in the direction of arrow 64, for transfer of the information onto the inner face of the cover member through means of the carbon spot. The recipient of the card may simply remove the cover member 62 from the base member 60 along the line of perforations 63 to view the normally hidden information transferred onto the cover member. Alternatively, the image transferred onto the cover member may be viewed by removing the section of base member surrounded by the perforations. In addition, separate tear lines in the form of perforations, or the like, may be provided at the base member adjacent the line of attachment perforations 63 to facilitate removal of the base member section for viewing the indicia at the inside surface of the cover member 62. The use of such tear lines is particularly appropriate where adhesive, or similar means, are used to secure the cover and base members together.

Figure 8:
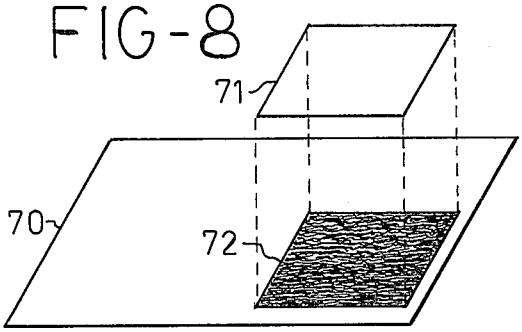
FIG. 8 is a view which is similar to that of FIG. 3 but showing a modified form of this invention employing impression transfer means for producing hidden indicia in color.
Figure 9:
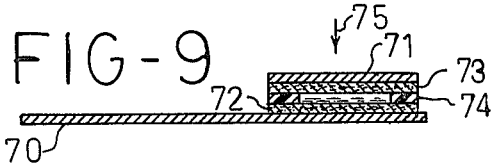
FIG. 9 is a cross sectional view of the post card shown in FIG. 8 taken across the cover member.

In another embodiment of this invention, shown in FIGS. 8 and 9, impression transfer means for producing a hidden image in color is shown. This arrangement includes a post card-sized base member 70 and cover member 71 of opaque material attached to the base member for concealing from view information provided beneath the cover member at a portion of the base member. A spot 72 of color producing material is provided on the base member at the area to be concealed, and the inner face of the cover member 71 is provided with a coating 73 of pressure-sensitive coloring agent. The coated cover member 71 is secured to the coated spot 72 as by adhesive 74 extending about the marginal edge of the cover member. After the coated elements are attached together, information to be hidden from view is supplied to the base member 70 by impressing the cover member 71 with the desired information, in the direction of arrow 75. At the impression, the pressure-sensitive coloring agent 73 combines with the coating of color-producing material 72 to produce a hidden image of the impression at the base member, which is viewable by the recipient upon removal of the cover member 71 from the base member 70.

Figure 10:
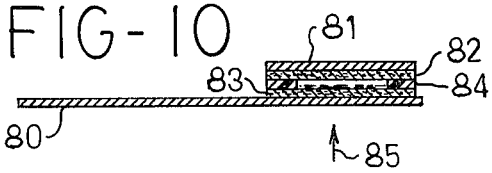
FIG. 10 is a cross sectional view similar to that of FIG. 9 but showing another modified form of this invention wherein the impression transfer means are oriented for transfer of the impression onto the inside surface or the cover member, rather than on the surface of the base member.

A similar arrangement for the production of colored images is shown in FIG. 10 wherein the color producing material is coated on the cover member, and the pressure-sensitive coloring agent is coated on the base member. This is in contrast to the above-described arrangement wherein the color producing material and pressure-sensitive coloring agent are coated on the base and cover members, respectively. Referring to FIG. 10, the illustrated post card comprises a base member 80, a cover member 81, a coating of color producing material 82 on the cover member, a coating of pressure-sensitive coloring agent 83 on the base member at the portion thereof which is normally hidden from view, and adhesive means 84 on the coated cover member adjacent the periphery thereof for securing the same to the base member. Hidden information to be transmitted generally is impressed on the base member 80 in the direction of arrow 85, for transfer thereof onto the inner face of the cover member 81 through the image transfer coatings 82 and 83. The message is exposed to view by removal of the cover member 81 by the recipient of the post card. Any well known color-producing material and associated pressure-sensitive coloring agents may be used in the practice of this invention. Also, the cover member may be impressed using characters which are mirror images of those normally employed, for transfer of an indicia of the impression onto the inside face of the cover member.

Figure 11:
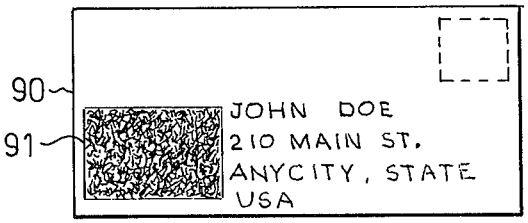
FIG. 11 is a front view of the post card shown in FIG. 10 showing camouflage printing for hiding from view printing made at the front of the post card while impressing the image to be transferred onto the front of the post card.

When the information to be hidden from view is impressed by use of visible printing means, or the like, the base or cover member may be provided with camouflage printing to hide the same from view. In FIG. 11, to which reference now is made, a post card is shown comprising a base member 90 with an area 91 at the face thereof covered with camouflage printing. This area is directly opposite image transfer means and a cover member of any of the types illustrated in FIGS. 3–10 and described above. Any printing on the camouflage area 91 is hidden from view, whereas the image thereof is transferred through the base member 90 for imaging at one of the facing surfaces between the cover and base member, depending upon the arrangement of the image transfer means therebetween. The camouflage area is printed before the image transfer means is applied to the post card to avoid transfer of the camouflage onto the surface of the hidden area. Obviously, the cover member may be supplied with camouflage printing to hide images provided thereon for transfer to one of the normally concealed surfaces between the cover and base members.

Figure 12:
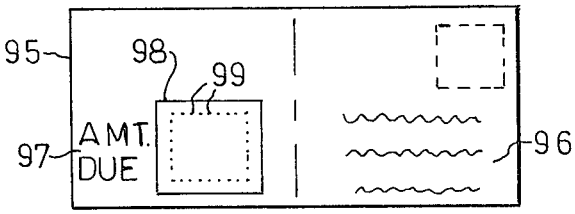
FIG. 12 is a front view of a post card showing a modified form of this invention wherein the cover member is applied to the front of the base member adjacent the name, address and postage area thereof.

In the arrangements of FIGS. 1–11 the cover member is shown attached to the rear surface of the base member. Obviously, it may be applied to the face thereof, to the left of the name, address, and post areas of the post card. In FIG. 12, a post card comprising a base member 95 having a name, address and postage are 96 to the right of the front surface, and a message area 97 to the left thereof, is shown. A cover member 98 is shown attached to the base member within the message area as by means of a line of perforations 99 extending along the edge of the cover member. Information to be hidden from normal view, such as an Amount Due a creditor, is located beneath the cover member 98 on the cover or base member, which information is viewable by the recipient of the post card by removal of the cover member from the base member as by tearing along the perforated line 99.

The invention having been described in detail in accordance with the requirements of the United States Patent Statutes, various other changes and modifications will suggest themselves to those skilled in this art. For example, more than one cover member, and associated image transfer means, where used, may be employed with a single base member, if desired, for the inclusion, of several normally hidden portions. It is intended that the above and other such changes and modifications shall fall within the spirit and scope of the invention as defined in the appended claims.

I claim:

1. A post card mailable at a post card postage rate for sending information, a portion of which normally is viewable and at least a portion of which normally is concealed from view, said post card comprising a base member of post card size and shape, an opaque cover member being less than one-half the size of said base member attached to said base member for concealing from view a hidden information area at one of the facing surfaces of the cover and base members, at least a portion of one of said cover member and base member adjacent said cover being removable for viewing by the recipient of the post card of the normally hidden information areas, and impression transfer means of substantially the same size as said cover member between said cover and base members for producing an image of an impression at one of the facing surfaces of the cover and base members from an impression at an outer face thereof.

2. A post card as defined in claim 1 wherein said impression transfer means comprises a slip of carbon paper positioned between said cover and base members.

3. A post card as defined in claim 2 wherein said slip of carbon paper is positioned for producing an image at the base member.

4. A post card as defined in claim 2 wherein said slip of carbon paper is positioned for producing an image at the cover member.

5. A post card as defined in claim 1 wherein said impression transfer means comprises a carbon spot on said base member adjacent said cover member.

6. A post card as defined in claim 1 wherein said cover member comprises a slip of duplicating pressure-sensitive paper for imaging on the base member through impressions made on said cover member.

7. A post card as defined in claim 1 wherein said impression transfer means comprises a layer of color producing material on one of the facing surfaces of the cover and base members and a coating of pressure-sensitive coloring agent on the other of said facing surfaces for production of an image at one of the facing surfaces of impressions made at the outer face of one of said base and cover members.

8. A post card as defined in claim 1 including a series of perforations through the base and cover members along the marginal edges of the cover member for attaching the same to the base member.

9. A post card as defined in claim 1 wherein said cover member and impression transfer means are less than one-half the size of said base member.

10. A post card for mailing at post card postage rates comprising, a base member of post card size and shape having opposite front and rear surfaces, a name, address and postage area at the front surface of the base member, a message area at one of the surfaces of the base member including normally visible and normally hidden portions, an opaque cover member being less than one-half the size of said base member, impression transfer means of substantially the same size as said cover member between said cover and base members for producing an image of an impression at one of the facing surfaces of the cover and base members from an impression at an outer face thereof, and means for removable attaching said cover member to the base member for covering the normally hidden portion of the message area to conceal the same from view, said cover member being removable by the recipient of the post card for viewing of the hidden message portion beneath the cover member.

* * * * *